United States Patent [19]

Acuff

[11] 4,219,197

[45] Aug. 26, 1980

[54] WORD GAME USING CARDS AND A ROW DESIGNATOR

[76] Inventor: Daniel S. Acuff, 441 Chelsea Way, San Gabriel, Calif. 91775

[21] Appl. No.: 964,033

[22] Filed: Nov. 27, 1978

[51] Int. Cl.[2] ..... A63F 1/00

[52] U.S. Cl. ..... 273/299; 35/35 J; 35/71; 273/146; 273/305

[58] Field of Search ..... 273/299, 303, 304, 305, 273/306, 146; 35/35 J, 71

[56] References Cited

U.S. PATENT DOCUMENTS

| | | | |
|---|---|---|---|
| 178,863 | 6/1876 | Levy | 273/303 |
| 244,745 | 7/1881 | Goldey | 273/299 |
| 2,128,749 | 8/1938 | Koch et al. | 273/299 X |
| 2,265,334 | 12/1941 | Armbruster | 273/299 |

FOREIGN PATENT DOCUMENTS

| | | | |
|---|---|---|---|
| 24658 | of 1910 | United Kingdom | 273/304 |
| 1273490 | 5/1972 | United Kingdom | 273/304 |

*Primary Examiner*—Anton O. Oechsle
*Attorney, Agent, or Firm*—Christie, Parker & Hale

[57] ABSTRACT

A deck of playing cards with two rows of word components printed in the card corners along with standard playing card suit designations. In addition, a row designator device, such as a six-sided die, is used with the deck to mandate which row or rows of letters on the cards must be used by the players in word formation. The result is a card game which combines the concept of word formation with the organizational principles of poker.

2 Claims, 5 Drawing Figures

Fig. 1

WORD COMPONENT OCCURRENCE AND DISTRIBUTION CHART

| SPADE | | CLUBS | | HEARTS | | DIAMONDS | |
|---|---|---|---|---|---|---|---|
| TOP ROW | BOTTOM ROW | TOP ROW | BOTTOM ROW | TOP ROW | BOTTOM ROW | TOP ROW | BOTTOM ROW |
| E | P | U | SS | A | PRE | A | DE |
| A | NG | E | SW | U | SH | A | RY |
| O | MENT | E | AC | E | ED | E | LK |
| I | EN | I | TE | L | EE | O | FUL |
| F | ION | G | ON | D | Y | J | TH |
| N | K | B | AI | T | OR | M | TR |
| H | RE | R | PE | SK | OU | S | IC |
| R | FL | C | S | NT | E | P | A |
| WH | OI | ST | GH | QU | SP | CH | W |
| CK | G | PR | ER | NK | A | SC | U |
| BR | E | AL | V | EX | O | KN | I |
| DE | R | BE | GR | AP | S | UN | X |
| IN | U | VE | E | PRO | N | ED | T |
| NE | E | LY | A | TE | LY | OUS | AN |
| BLE | M | ER | H | ZE | O | ES | E |
| ING | I | LL | A | TION | L | OO | C |
| Y | CO | OA | Z | IE | CR | EA | ES |

WORD GAME USING CARDS AND A ROW DESIGNATOR

DESCRIPTION OF THE PRIOR ART

This invention relates to improvements in card games. It particularly relates to a novel type of playing card and a deck of such cards which, when used in conjunction with a novel row designator device, can result in a variety of challenging and instructive word games and, especially, because of its structure, word games which simulate standard poker games, such as draw and stud poker.

Word games utilizing playing cards are known in the prior art. Each of these games involves the use of letter indicia on the cards to form either predetermined words (see for example U.S. Pat. No. 977,117) or to allow the player to form his own words (see U.S. Pat. No. 2,265,334). Other examples of word games using playing cards are shown in U.S. Pat. Nos. 1,076,307; and 2,783,998. Games currently available include "Sadie" and "Abaca," all of which involve decks of cards with letter indicia and are designed to be used in a variety of word games.

None of these decks of cards, however, is specifically structured with principles of organization and mechanics which provide for an accurate simulation of standard poker and poker deck-related games. Two of the games in the prior art, that shown in U.S. Pat. No. 2,265,334, and "Sadie," although designed specifically for other than poker-related word games, refer to poker play possibilities, but neither of them is particularly structured as is the presennt invention so as to maximize the simulation of poker deck-related games. As a consequence, interest in such games is diminished, and their play is not truly simulative.

In addition, of particular interest are the specific nature and characteristics of the letter indicia used in the prior art as opposed to that in this present invention. In the prior art, there is a game, U.S. Pat. No. 2,265,334, in which indicia selection and play is patterned after principles of organization present in the study of stenography. Also, there is the game "Abaca" which uses only single and double letter indicia. No known deck of cards or word card game, however, is patterned according to the principles of organization of the present invention with its particular letter indicia characteristics. In the present invention, indicia selection is based on a phonetic and word-part approach to the subject of reading. More specifically, in the card game according to the present invention, word components are utilized, such as whole prefixes and whole suffixes. No other known game is structured around this organizational principle.

SUMMARY OF THE PRESENT INVENTION

In the present invention, there is provided a novel deck of cards which is specifically structured to allow for the play of word games related to the standard card game known popularly as poker. Each card of this novel deck bears a suit designation such as spades, hearts, clubs, or diamonds, as do standard playing cards. Instead of numbers in opposing corners, there appear two vertically tiered rows of word components: single consonants and vowels, double consonants and vowels, "blends" (a reading term referring to two consonants which commonly combine, such as "SH"), complete prefixes and suffixes and diphthongs.

Thus, in one aspect the invention provides a word game utilizing playing cards comprising a plurality of individual cards with each card having a suit designation and a first and second selection of word components displayed thereon. Means are also provided for designating the choice of one or both selections of word components which when combined with word components of other cards spells out a word or words.

Also, in keeping with the desired simulative effect of poker organization, there are, preferably, two jokers or wild cards to be used with the novel deck, the jokers preferably to be used as any single letter of any suit.

Importantly, the word components selected and devised for this novel deck are carefully calculated so that almost any word in the English language can be formed on either row using a preferred compact deck of 70 cards. This feature is important to the simulative poker effect in that, in order to truly simulate such poker hands as four-of-a-kind and a full-house, the ability to form longer words with fewer cards is crucial. In addition, the invention is adaptable to the play of games such as solitaire, in which the object of the game is to use up all the cards in the word formation. The play of solitaire is facilitated by the deck according to the present invention in that, skillfully played, all the cards of this deck can be used up in word formation with none left over.

Also provided for in this present invention is a row designator, the preferred form being a die. This die bears the indicia "TOP," "BOTTOM" and "TOP or BOTTOM" and, used together with the novel deck, mandates which row or letter indicia on the cards must be used by the players in a given game.

Thus, in another aspect, the invention provides a deck of word component cards which has a simulative relation to a standard deck of playing cards so that poker and poker deck-related word games might be played. In addition to the poker advantages, the use of this particular distribution of word components results in high educational value, particularly in reading skill improvement, spelling improvement, and vocabulary expansion.

BRIEF DESCRIPTION OF THE DRAWINGS

Other objects and advantages of the present invention will be observable on reading the following description of one embodiment thereof which is presented in conjunction with the accompanying drawings in which:

FIG. 1 is a diagram of the card distribution and word component distribution according to the present invention;

DESCRIPTION OF A SPECIFIC EMBODIMENT

The particular distribution and occurrence of word components in a preferred basic deck of 68 cards presented according to their assigned suit is given in FIG. 1.

Figure 2:
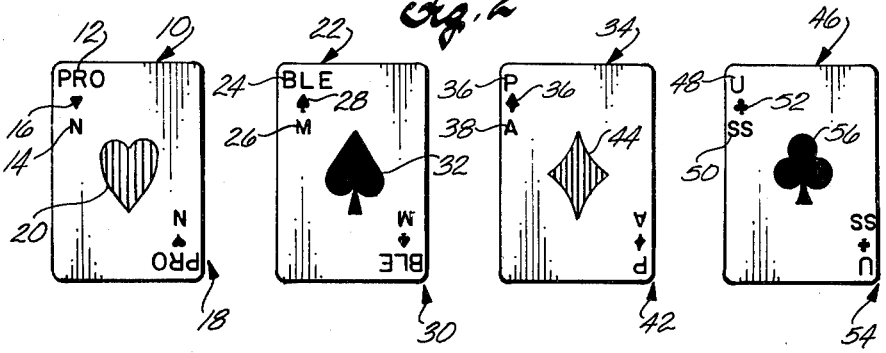
FIG. 2 is a view of four of the deck's playing cards.

The illustrations in FIG. 2 include a sample card from each suit in the preferred basic deck of 68 cards. Each card, preferably, is made of a standard plastic, plasticcoated, or other playing card material, and bears in its upper left corner, and inverted and repeated in size and form in its lower right corner, two vertically tiered rows of indicia which are selected from the following common word components: (1) single consonants and vowels; (2) double consonants and vowels; (3) prefixes; (4) suffixes; (5) diphthongs; and (6) blends. In the preferred rendition, the lower row of indicia on each corner on each card is presented in a smaller format than the upper row for easier readability. Blends are word components which are made up of two or more consonants and which are pronounced as a single unit such as SH and FL. Diphthongs are word components which are made up of two vowels which are pronounced as a single unit such as OU and IE.

The purpose of the two rows of indicia is twofold. First, because of the great number of possibilities of word-part inclusions in most languages, two rows allow for a compact deck of a manageable number of cards, and, secondly, used in conjunction with the preferred row designator, the die, it enhances the poker or gambling aspects of the invention.

As shown in FIG. 2, each card in its preferred form bears a standard playing card suit designation of spade, club, heart, or diamond. This serves three functions: (1) in the center, it is an attractive design element on the card faces; (2) in the corners, it serves as a visual or spatial separator of the two rows of indicia in the card corners; and (3) most importantly, it enhances and contributes to the use of the deck in the play of simulative poker card games, both by its design and by the suit designation's functional incorporation into the rules of various games to be played with the invention.

The specific characteristics of the letter indicia are of particular importance. This present invention is founded on the principles of organization present in the instruction of reading and spelling, in that whole word parts—entire prefixes, suffixes, diphthongs, blends, and other word components—are utilized on the cards. Importantly, this allows for longer, more interesting and more challenging words to be made with fewer cards, and this is an aspect of the invention. The possibility of longer word formation with fewer cards makes possible a more precise simulation of poker hand probabilities and, at the same time, it serves as a tool for the improved learning of reading and spelling.

Specifically referring to card 10 of FIG. 2, it is representative of the cards of the deck in the suit of hearts. In its upper left hand corner, it includes a word component 12 (PRO) and, beneath, another component 14 (N) in a vertical tier relationship. A heart suit designator 16 is bracketed between components 12, 14. These same indicia are inverted and repeated exactly in the lower right corner 18. At the center of card 10 is a larger heart suit designator 20.

Referring specifically to card 22 of FIG. 2, it is representative of the cards of the deck in the suit of spades. In its upper left hand corner, it includes a word component 24 (BLE) and, beneath, another component 26 (M) in a vertical tier relationship. A spade suit designator 28 is bracketed between components 24, 26. These same indicia are inverted and repeated exactly in the lower right corner 30. At the center of card 22 is a larger spade suit designator 32.

Specifically referring to card 34 of FIG. 2, it is representative of the cards of the deck in the suit of diamonds. In its upper left hand corner, it includes a word component 36 (P) and, beneath, another component 38 (A) in a vertical tier relationship. A diamond suit designator 40 is bracketed between components 36, 38. These same indicia are inverted and repeated exactly in the lower right corner 42. At the center of card 34 is a larger diamond suit designator 44.

Referring specifically to card 46 of FIG. 2, it is representative of the cards of the deck in the suit of clubs. In its upper left hand corner, it includes a word component 48 (U) and, beneath, another component 50 (SS) in a vertical tier relationship. A club suit designator 52 is bracketed between components 48, 50. These same indicia are inverted and repeated exactly in the lower right corner 54. At the center of card 46 is a larger club suit designator 56.

Figure 3:
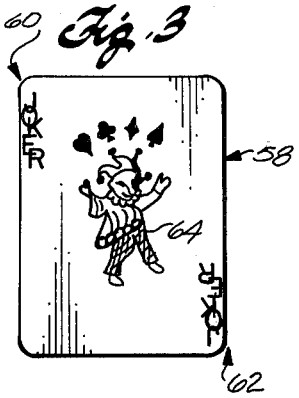
FIG. 3 is a representation of a joker or wild card.

FIG. 3 is a specific embodiment of one of preferablly two jokers to be included in the novel deck. The joker functions as a wild card and preferably can be used as any single letter in word formation. For example, if a player had cards 22 and 34 of FIG. 2 he could use a joker 58 as an (E) and place it between word component 24 (BLE) and word component 36 (P) to form the word "BLEEP." In specific reference to the joker card 58, in the upper left hand corner 60 there is the vertically and stylistically written word, "JOKER." This same word is inverted and repeated exactly in the lower right hand corner 62. At the center of card 58 is a joker design figure 64.

Figure 4:
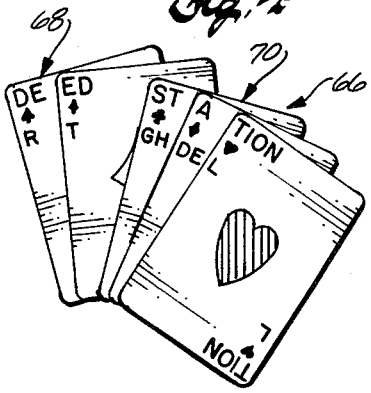
FIG. 4 is a representation of a "full-house" poker hand using the invention.

FIG. 4 of the drawings is a representation of a five-card draw poker hand 66. This particular hand is a representation of a "FULL HOUSE" hand, one of many possible "hands" that can be formed. The other draw poker hands are enumerated elsewhere in this disclosure. In specific reference to this "FULL HOUSE" hand 66, it is made up to a two-card word, "DEED" 68, and a three-card word, "STATION" 70, in this case using the top row of card indicia.

Figure 5:
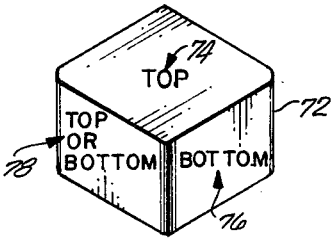
FIG. 5 is a perspective view of a die used with the invention as an implement for selecting the row of word components from the associated cards of the deck.

FIG. 5 is a view of the preferred row designator, a die 72. The indicia "TOP," "BOTTOM", and "TOP or BOTTOM" each appear twice respectively on the six faces of the die, and it is these designations which mandate which row of letter indicia on the cards the players must use. The use of a row designator in conjunction with a deck of playing cards is a unique feature of the present invention. The die is made of any suitable material such as ivory, wood, or plastic, and is a conventional six-sided cube. In one embodiment the die is wider than it is high to decrease the probability that the die will land on one of its side surfaces, thereby decreasing the probability of rolling a "TOP or BOTTOM" designator. In reference to this specific drawing, it is a perspective view of a row designator die and includes the indicia "TOP" 74 on the upper part of the die, the indicia "TOP or BOTTOM" 78 on the left side, and the indicia "BOTTOM" 76 at the front part of the die. A die is only the preferred form of a row designator. Other row designator devices could be used as readily, such as a spinner or a selection of cards.

In keeping with the desired simulative poker effect, the game includes, in one embodiment, poker chips or paper money, as well as an instruction booklet which emphasizes the simulated play of poker and poker-related games.

Because of its organizational structure, there are a wide variety of word games which can be played with a preferred basic deck of 68 cards, two jokers, and a row designator device. In particular because of the inclusion of standard playing card suit designations, corner indicia which invert and repeat themselves exactly in diagonally opposing corners of the cards, and a distribution of word components which facilitates the simulation of poker deck-related games, the game lends itself to the playing of basic poker games such as Five-card Draw. Without the unique combination of these elements, the highly simulative relationship of the present invention to the game of poker would not exist.

The play of a simulated game of Five-card Draw Poker using the deck and designator of the present invention is as follows:

It is played just as it is in regular poker, including such elements as antes, rounds of betting, the drawing of new cards, and raises, except for the following modifications: (1) cards are combined to form words instead of such things as pairs, straights, and flushes; (2) a row designator is used to determine the row of indicia to be used by the players; (3) there is an alternative point scoring system provided for tie-breaking; and (4) the rank of hands for determining the winner of a five-card draw hand is as follows:

| | | Point Value |
|---|---|---|
| Highest - 1. | A five-card word | 100 |
| 2. | A four-card word | 50 |
| 3. | A three-card word & a two-card word (Full House) | 25 |
| 4. | A two-card word & a two-card word | 15 |
| 5. | A three-card word | 10 |
| Lowest - 6. | A two-card word | 5 |

The step-by-step procedure for play for Five-Card Draw using the present invention is as follows:

Step 1: Players place "ante" (a small value in chips or money) as designated by the dealer in the center of the playing area to form a "pot."

Step 2: The row die is either rolled or simply used by the dealer to determine the designated row or rows.

Step 3: The dealer deals, starting with the player on his left, five cards face down to each player, one round at a time.

Step 4: Each player forms his best possible hand using only the designated row.

Step 5: First round of betting: The player to the dealer's left has the option of "opening" the betting. Just as in regular poker, if he chooses not to open the betting, then he "passes" and the option is passed to his left, and so forth. If no one chooses to bet, the hand is re-dealt. After the bet has opened, players must bet a like amount or "drop" from the hand. Or, if a player feels he has a strong hand, he may decide to "raise" the bet higher by some limited amount in his turn. There is a maximum of three raises in any round of betting.

Step 6: Players exchange, if they desire, up to three cards with the dealer to try to improve their hands.

Step 7: Final round of betting: The final bet begins with the player who opened the bet in the first round.

Step 8: Players show their hands in order to determine the winner according to the rank of hands.

Other draw poker games that can be played using these same procedures except for minor alterations in the rules are "Six-card" and "Seven-card" draw, "Lowball," and "Four or Better." These minor alterations are briefly given as follows:

1. The procedure for playing Six and Seven-card Draw is different only in that: (A) six and seven cards respectively are dealt to the player instead of five; (B) the player may only use his best five cards.

2. The procedure for playing Lowball is the same as for Five-card Draw except that the worst hand wins instead of the best. In the case of the present invention, that would be the hand with no word formation possibilities, or the least possibilities.

3. The procedure for playing Four or Better is the same as for poker Five-card Draw except that in order for a player to win (take the pot) in Four or Better he must form a four-card word or better hand.

A significant parallel between this present invention and a standard playing card deck used to play poker can now be demonstrated. Critical to the play of almost all poker games is the mathematically based odds against the probability of the occurrence of specific poker hands on the original five cards dealt. According to *Hoyle Up-To-Date,* for a 52-card deck, nothing wild, these are the odds to the nearest whole number:

| | |
|---|---|
| Royal Flush | 649,739 to 1 |
| Straight Flush | 72,192 to 1 |
| Four-of-a-kind | 4,165 to 1 |
| Full House | 694 to 1 |
| Flush | 508 to 1 |
| Straight | 254 to 1 |
| Three-of-a-kind | 46 to 1 |
| Two Pairs | 21 to 1 |
| One Pair | 2 to 1 |

In this present invention, even with the more subjective nature of skill in word formation involved, probabilities of odds are also possible of estimation though not precise mathematical calculation. These odds have been estimated as follows:

| | | |
|---|---|---|
| A five-card word | (Simulative of five-of-a-kind in poker) | 131 to 1 |
| A four-card word | (Simulative of four-of-a-kind in poker) | 15 to 1 |
| A three-card word & a two-card word | (Full House in poker) | 9 to 1 |
| A two-card word & a two-card word | (Two pair in poker) | 5 to 1 |
| A three-card word | (Simulative of three-of-a-kind in poker) | 2 to 1 |
| A two-card word | (Simulative of a pair in poker) | 1.4 to 1 |

In the present invention, the odds against the different hand combinations, although much smaller than standard poker odds, do actually parallel regular poker odds in that the odds ascend from a very easy combination of cards (two-card word) to a very difficult one (five-card word). This parallel between the present invention and a regular poker game, combined with suit designation and other poker-like features herein described, allows for a more accurate simulation of poker games to occur than with other known word card game inventions.

Stud poker games such as "Five-card," "Six-card," and "Seven-card" stud can also easily be played with the present invention. The procedures for play are identical to regular poker stud games, except for the same word formation modifications as indicated in the above description of Five-card Draw. Notably, the suit designation and standard suit colors of red for hearts and diamonds and black for clubs and spades on the present deck contribute to two variations of stud games that can be played: (1) "Suited Seven-card Stud" in which the basic modification is that players can form words only using cards of like suit; and (2) "Red and Black Stud" which limits word formation to cards of like color.

A game called "Risk" is a special adaptation, using the present deck, of a standard poker game called "In-Between" or "Acey-Deucy." In "Risk," two cards are dealt each player face up. The player may use either row of indicia as desired. Starting with the player on the dealer's left, this player may pass or choose to bet any portion or all of the pot that a third card dealt to him will enable him to form a three-card word on either row. If he wins, he takes the amount that he bet from the pot and play continues to the next player. If he loses, then he places his bet into the pot and play continues in this way until someone wins the entire pot.

Just as a standard playing card deck is used for games other than poker, such as "Bridge" and "Hearts" and "Solitaire," this novel deck can also be used for other games. The game of "Gin Rummy" is particularly adaptable to the present deck and includes all the elements of standard playing card deck gin rummy, such as "knocking" "melding," "going out" and "undercutting." The basic modification, other than slightly different scoring procedures, is that the matched sets or "melds" are made up of words instead of numbers or face cards. In addition to "Gin Rummy," a number of forms of "Solitaire" can be played with this present invention. As in most forms of poker deck solitaire, the object of these games is to "go out" by using up all the cards, in this case in the formation of words.

A game that has been especially created for the present deck is called "Expansion." The object of this game is to cooperate with the other players, each in his turn, in the formation of as long a word as possible in the center of the player area, and then to take this word as a valuable "trick" for one's own by being the last player to add a card to it. A further object of the game is to use up all the cards in one's hand in the formation of such words, and thereby to go out. A special scoring system is provided which places higher value on longer words and which gives a bonus in points to a player who can go out, and penalty points for each card left in a player's hand at the end of the game.

These games as described are merely preferred forms of games that can be played with the invention. A wide variety of other games can be devised using this novel card deck and row designator.

In summary, in the present invention, we have a novel type of playing card and deck of such cards, which, when used in conjunction with a novel row designator, can result in the playing of a wide variety of interesting, fun, and educational word games, and, especially because of its unique structure and principles of organization, word games which closely simulate standard poker games.

Various modifications of this invention may be made by individuals skilled in the art without departing from the specifics and scope of the invention as defined in these claims:

What is claimed is:

1. A word game utilizing playing cards comprising:

a plurality of cards constituting a deck, each card having three rows of designations thereon, two of said rows comprising word components in a top row and a bottom row and the third row comprising a suit designator, wherein the distribution of word components on each card in each suit is according to the following:

| SPADES | | CLUBS | |
|---|---|---|---|
| top row | bottom row | top row | bottom row |
| E | P | U | SS |
| A | NG | E | SW |
| O | MENT | E | AC |
| I | EN | I | TE |
| F | ION | G | ON |
| N | K | B | AI |
| H | RE | R | PE |
| R | FL | C | S |
| WH | OI | ST | GH |
| CK | G | PR | ER |
| BR | E | AL | V |
| DE | R | BE | GR |
| IN | U | VE | E |
| NE | E | LY | A |
| BLE | M | ER | H |
| ING | I | LL | A |
| Y | CO | OA | Z |
| HEARTS | | DIAMONDS | |
| top row | bottom row | top row | bottom row |
| A | PRE | A | DE |
| U | SH | A | RY |
| E | ED | E | LK |
| L | EE | O | FUL |
| D | Y | J | TH |
| T | OR | M | TR |
| SK | OU | S | IC |
| NT | E | P | A |
| QU | SP | CH | W |
| NK | A | SC | U |
| EX | O | KN | I |
| AP | S | UN | X |
| PRO | N | ED | T |
| TE | LY | OUS | AN |
| ZE | O | ES | E |
| TION | L | OO | C |
| IE | CR | EA | ES |

2. A deck of playing cards having specific word component indicia displaying therein wherein the frequency of distribution of the word components is according to the following:

| | |
|---|---|
| Single vowels | 30 |
| Double vowels | 2 |
| Diphthongs | 6 |
| Single consonants | 31 |
| Double consonants | 2 |
| Prefixes | 21 |
| Suffixes | 21 |
| Blends | 23 |

* * * * *